US009862474B2

(12) United States Patent
Choo et al.

(10) Patent No.: US 9,862,474 B2
(45) Date of Patent: Jan. 9, 2018

(54) VENTILATION APPARATUS OF A DRILLSHIP

(75) Inventors: Keum Dae Choo, Gyeongsangnam-do (KR); Yu Young Lee, Gyeongsangnam-do (KR); Jung Yul Choi, Gyeongsangnam-do (KR); Jung Soo Kang, Gyeongsangnam-do (KR); D. Scott Brittin, Katy, TX (US)

(73) Assignees: DAEWOO SHIPBUILDING & MARINE ENGINEERING CO., LTD., Seoul (KR); TRANSOCEAN SEDCO FOREX VENTURES LIMITED, George Town (KY)

( * ) Notice: Subject to any disclaimer, the term of this patent is extended or adjusted under 35 U.S.C. 154(b) by 534 days.

(21) Appl. No.: 13/811,985

(22) PCT Filed: Jun. 22, 2011

(86) PCT No.: PCT/KR2011/004557

§ 371 (c)(1),
(2), (4) Date: Jun. 28, 2013

(87) PCT Pub. No.: WO2012/015170

PCT Pub. Date: Feb. 2, 2012

(65) Prior Publication Data

US 2013/0273823 A1 Oct. 17, 2013

(30) Foreign Application Priority Data

Jul. 27, 2010 (KR) ..... 10-2010-0072573

(51) Int. Cl.

| | |
|---|---|
| ***B63J 2/02*** | (2006.01) |
| ***B63B 35/44*** | (2006.01) |
| ***B63J 2/10*** | (2006.01) |

(52) U.S. Cl.
CPC ..... *B63J 2/02* (2013.01); *B63B 35/4413* (2013.01); *B63J 2/10* (2013.01)

(58) Field of Classification Search
CPC ..... B63J 2/10; B63J 2/02; B63J 2/00; B63J 2/12; B63B 35/4413; E21B 15/02
(Continued)

(56) References Cited

U.S. PATENT DOCUMENTS 2,153,350 A 4/1939 Stimac
2,691,272 A 10/1954 Townsend et al.
(Continued)

FOREIGN PATENT DOCUMENTS

GB 611961 A 11/1948
GB 1 218 530 A 1/1971
(Continued)

OTHER PUBLICATIONS http://news.bbc.co.uk/2/hi/in_depth/629/629/7214857.stm BBC news. Jan. 30, 2008.*

*Primary Examiner* — Steven B McAllister
*Assistant Examiner* — Ko-Wei Lin
(74) *Attorney, Agent, or Firm* — Seed IP Law Group LLP

(57) ABSTRACT

Provided is a ventilating apparatus for a drill ship, which allows a drill ship sailing around an arctic region to maintain appropriate temperature and pressure. The ventilating apparatus for the drill ship includes: a derrick forming an enclosed space blocked from the exterior; a moonpool formed under the derrick; an air supply device supplying outside air to the moonpool or the derrick; and an air exhaust device exhausting the supplied outside air out of the top of the derrick.

10 Claims, 3 Drawing Sheets

(58) Field of Classification Search
USPC ..... 175/5, 52; 114/211, 264, 268, 212; 405/211, 217; 166/345, 353, 355, 367; 454/78
See application file for complete search history.

(56) References Cited

U.S. PATENT DOCUMENTS

| | | | | | |
|---|---|---|---|---|---|
| 2,804,951 | A | | 9/1957 | Kolt | |
| 3,093,056 | A | * | 6/1963 | Rosenfeld | 454/253 |
| 3,279,407 | A | * | 10/1966 | Stenger | B63B 1/107 114/125 |
| 3,461,828 | A | * | 8/1969 | Bielstein | 114/265 |
| 3,593,645 | A | * | 7/1971 | Day et al. | 454/315 |
| 3,626,836 | A | | 12/1971 | Schneidler | |
| 3,850,125 | A | | 11/1974 | Anders | |
| 4,053,732 | A | * | 10/1977 | Carter | 392/358 |
| 4,407,185 | A | | 10/1983 | Haines et al. | |
| 4,487,214 | A | * | 12/1984 | Tatum | 137/72 |
| 4,613,001 | A | | 9/1986 | Edberg et al. | |
| 4,627,767 | A | * | 12/1986 | Field | E02B 17/0021 114/264 |
| 4,666,341 | A | | 5/1987 | Field et al. | |
| 4,991,532 | A | | 2/1991 | Locke | |
| 5,927,222 | A | | 7/1999 | Eakin et al. | |
| 7,413,007 | B2 | * | 8/2008 | Yamaoka | 165/202 |
| 2003/0196791 | A1 | | 10/2003 | Dunn et al. | |
| 2005/0191136 | A1 | * | 9/2005 | Xu | 405/203 |
| 2008/0009233 | A1 | | 1/2008 | Leseman et al. | |
| 2008/0115998 | A1 | * | 5/2008 | Naganuma et al. | 180/314 |
| 2010/0291857 | A1 | * | 11/2010 | Cho et al. | 454/239 |

FOREIGN PATENT DOCUMENTS

| | | | | | |
|---|---|---|---|---|---|
| GB | 2110602 | A | * | 6/1983 | B63B 35/44 |
| JP | 60-62369 | A | | 4/1985 | |
| JP | 60-126589 | U | | 8/1985 | |
| JP | 63-6998 | U | | 1/1988 | |
| JP | 2-100994 | U | | 8/1990 | |
| JP | 3002545 | B2 | | 1/2000 | |
| JP | 2000238695 | A | | 9/2000 | |
| JP | 2005-306315 | A | | 11/2005 | |
| KR | 20-0226940 | Y1 | | 6/2001 | |
| KR | 10-2004-0020440 | A | | 3/2004 | |
| KR | 20-0431766 | Y1 | | 11/2006 | |
| KR | 10-2009-0053184 | A | | 5/2009 | |
| KR | 10-2010-0028480 | A | | 3/2010 | |
| WO | 97/42393 | A1 | | 11/1997 | |

* cited by examiner

*(Prior Art)*

[Fig. 2]
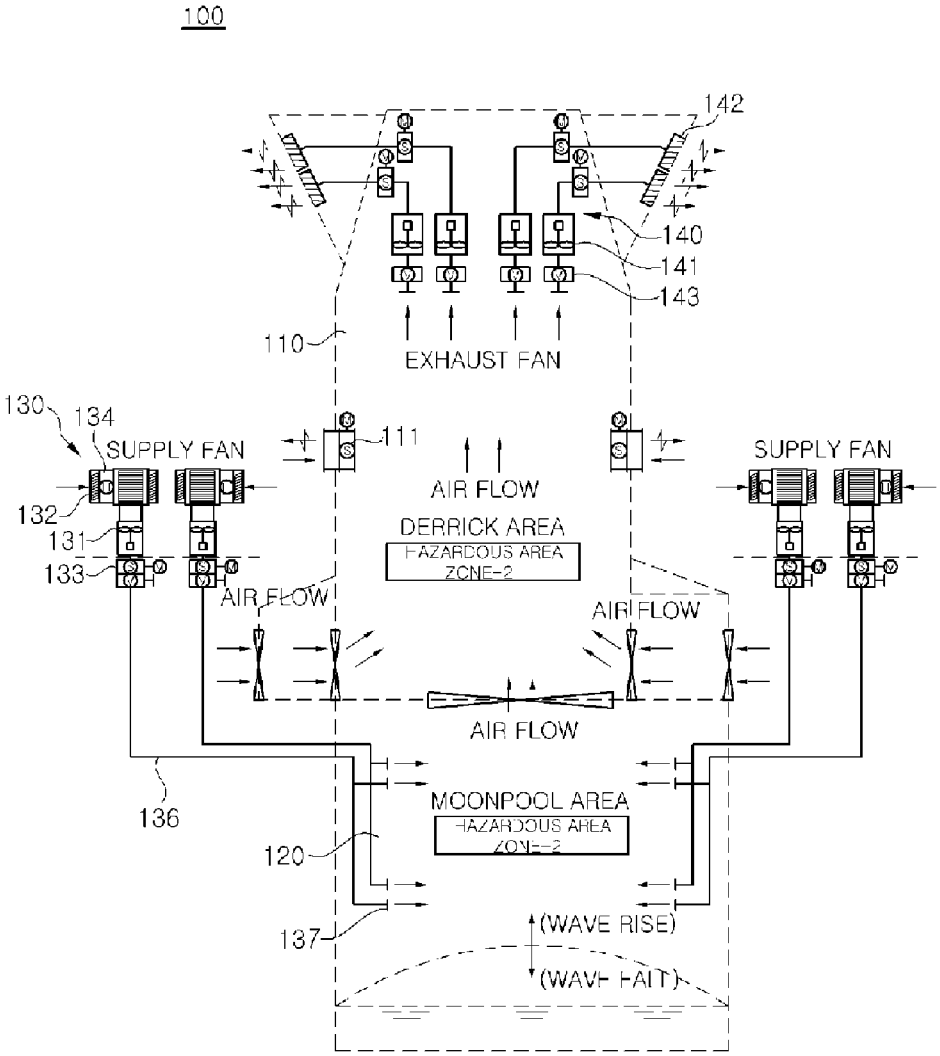

[Fig. 3]
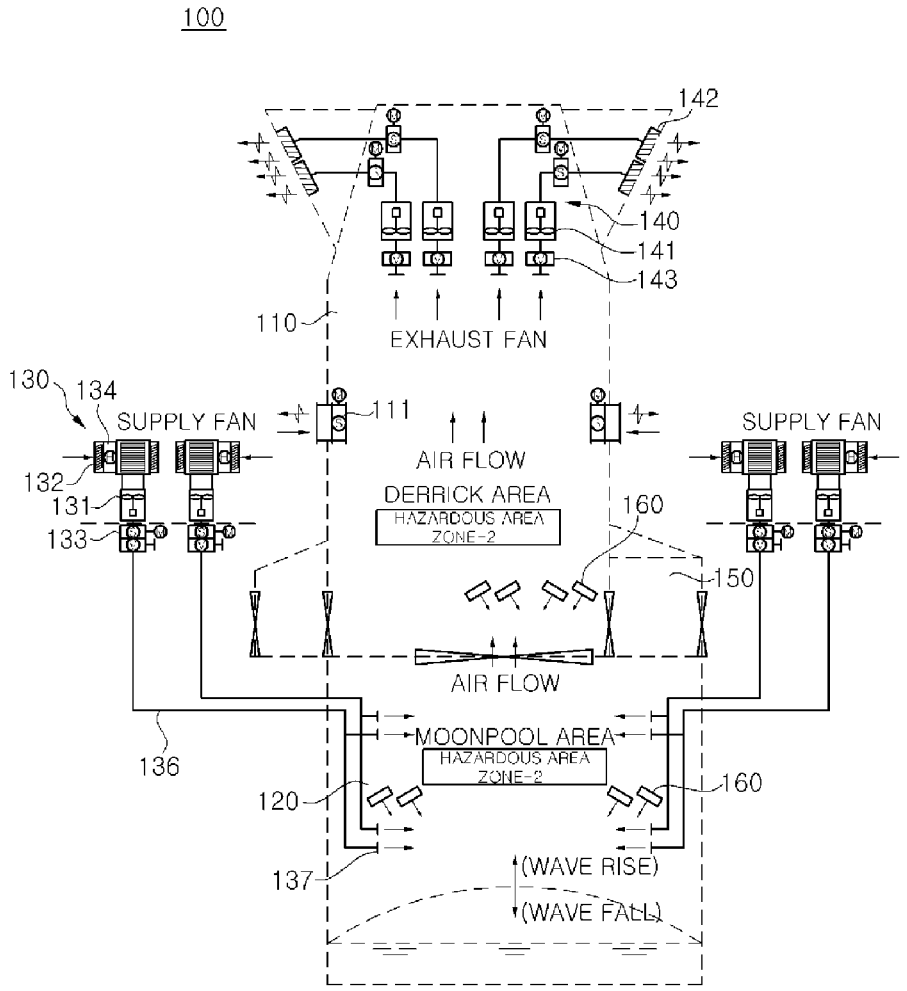

VENTILATION APPARATUS OF A DRILLSHIP

CROSS-REFERENCE(S) TO RELATED APPLICATION

This application is a national stage application filed under 35 U.S.C. §371 of International Application No. PCT/KR2011/004557, accorded an International Filing Date of Jun. 22, 2011, which claims priority of Korean Patent Application No. 10-2010-0072573, filed on Jul. 27, 2010, in the Korean Intellectual Property Office, which is hereby incorporated by reference in its entirety.

BACKGROUND

Technical Field

The present disclosure relates to a drill ship, and more particularly, to a ventilating apparatus for a drill ship, which allows the drill ship sailing around an arctic region to maintain appropriate temperature and pressure.

Description of the Related Art

Due to the rapid international industrialization and industrial development, the use of the earth's resources, such as oil, is gradually increasing. Accordingly, stable production and supply of oil is emerging as a very important worldwide issue.

For this reason, much attention has recently been paid to development of small marginal fields or deep-sea oil fields, which have been ignored because of their low economic feasibility. Therefore, with the development of offshore drilling techniques, drill ships equipped with drilling equipment suitable for development of such oil fields have been developed.

In conventional offshore drilling, rig ships or fixed type platforms have been mainly used, which can be moved only by tugboats and are anchored at a position on the sea using a mooring gear to conduct an oil drilling operation. In recent years, however, so-called drill ships have been developed and used for offshore drilling. The drill ships are provided with advanced drilling equipments and have structures similar to typical ships such that they can make a voyage using their own power.

Meanwhile, a moonpool is formed at the center of a drill ship equipped with a variety of drilling equipments, such that a riser or a drill pipe for drilling oil or gas existing under the sea bed is vertically movable through the moonpool.

FIG. 1 is a side view illustrating a conventional drill ship which performs a drilling operation on the sea.

A derrick 2 is fixedly installed on a deck of a drill ship 1. The derrick 2 is a large complicated structure provided with beams and a variety of drilling equipment. The derrick 2 is a type of tower in which all drilling equipment installed around the moonpool 3 of the drill ship 1 are integrated. In addition, the derrick 2 is provided for vertically moving drilling equipment such as a drill pipe 5. The derrick 2 vertically moves the drilling equipment to a desired position by winding or unwinding a wire rope coupled to the drilling equipment by a winch operation. The drill ship 1 may use one derrick or two derricks.

A worker drills for submarine resources stored in an oil well 13, which is located in a reservoir 12 under a sea bed 6, by moving a riser 4 and a drill pipe 5 downwardly through the moonpool 3 formed at the center of the drill ship 1.

The riser 4 is a member that moves to the sea bed 6 before the drill pipe 5 moves downwardly to the oil well 13, and it provides a passage through which mud is returned. When the riser 4 is installed, the drill pipe 5 moves downwardly through a sea bed layer 11 to the oil well 13 along the inside of the riser 4.

In the case where the riser 4 moves downwardly to the sea bed 6 or the drill pipe 5 moves downwardly to the oil well 13, short risers 4 or short drill pipes 5 are coupled together and move downwardly. A blowout preventer (BOP) 7 is installed on the sea bed 6 to prevent abnormal pressure from blowing out along the drill pipe 5. A casing 8 is fixed to the sea bed layer 11 by cement, and the drill pipe 5 with a drill bit 10 is inserted into the casing 8. Then, the submarine resources are drilled. The drill bit 10 may be overheated by heat generated when the drill bit 10 drills the ground. Therefore, a mud 9 is inserted into the drill pipe 5 in order to prevent the overheating of the drill bit 10, and the mud 9 serves to lubricate the drill bit 5, thereby further facilitating the drilling operation. The mud 9 is discharged out of the drill bit 10 and is returned through the casing 8 and the riser 4. When the drilling operation is completed, the drill pipe 5 is carried to a drill floor through the moonpool 3 and then is separated and delivered to a storage facility.

In the case of the conventional drill ship, as described above, the derrick has an opened structure in which steel pipes are coupled together, like a power transmission tower installed on the ground. Therefore, natural ventilation is possible without any separate mechanical ventilating apparatus.

However, if the conventional derrick having the opened structure is installed in a drill ship which sails around an arctic region, a variety of drilling equipment is exposed to at below zero temperatures for a long time. Consequently, the drilling equipment may not operate normally.

BRIEF SUMMARY

An aspect of the present invention is directed to a ventilating apparatus for a drill ship, which maintains temperatures and pressures of a moonpool and a derrick at appropriate levels, considering the influence of temperature and waves, such that the drill ship can operate efficiently in an arctic region.

According to an embodiment of the present invention, a ventilating apparatus for a drill ship includes: a derrick forming an enclosed space blocked from the exterior; a moonpool formed under the derrick; an air supply device supplying outside air to the moonpool or the derrick; and an air exhaust device exhausting the supplied outside air out of the top of the derrick.

The air supply device may include a heater which heats the outside air.

The air supply device may include a shut-off damper which shuts off an air flow when an emergency situation occurs while the drill ship is sailing.

The air supply device may include a supply louver which prevents the inflow of particles other than air.

The derrick may include an openable/closable air supply port through which the outside air is supplied.

The derrick may include a pressure regulating damper which supplies or exhausts air such that the internal pressure of the derrick is constantly maintained.

The ventilating apparatus may further include a heat blower provided inside the derrick to heat air in order for effective ventilation.

The air exhaust device may include an exhaust louver which prevents the inflow of particles other than air.

A supply fan may be installed in the air supply device, and an exhaust fan may be installed in the air exhaust device.

The operating speeds of the supply fan and the exhaust fan may be changed depending on temperature of the outside air.

The air supply device may supply the outside air to the moonpool or the derrick through a duct, and a wire mesh may be provided at the end of the duct which is coupled to the moonpool or the derrick.

According to another embodiment of the present invention, a ventilating apparatus for a drill ship, which has a derrick provided on a deck and a moonpool provided under the derrick and contacted with seawater, is characterized in that outside air is supplied to the derrick or the moonpool and is exhausted out of the top of the derrick, whereby air is ventilated.

BRIEF DESCRIPTION OF THE SEVERAL VIEWS OF THE DRAWINGS

FIG. 2 is a conceptual diagram illustrating a situation in which a ventilating apparatus for a drill ship sailing around an arctic region is operating in a hot season.

FIG. 3 is a conceptual diagram illustrating a situation in which a ventilating apparatus for a drill ship sailing around an arctic region is operating in a cold season.

DETAILED DESCRIPTION

Figure 1:
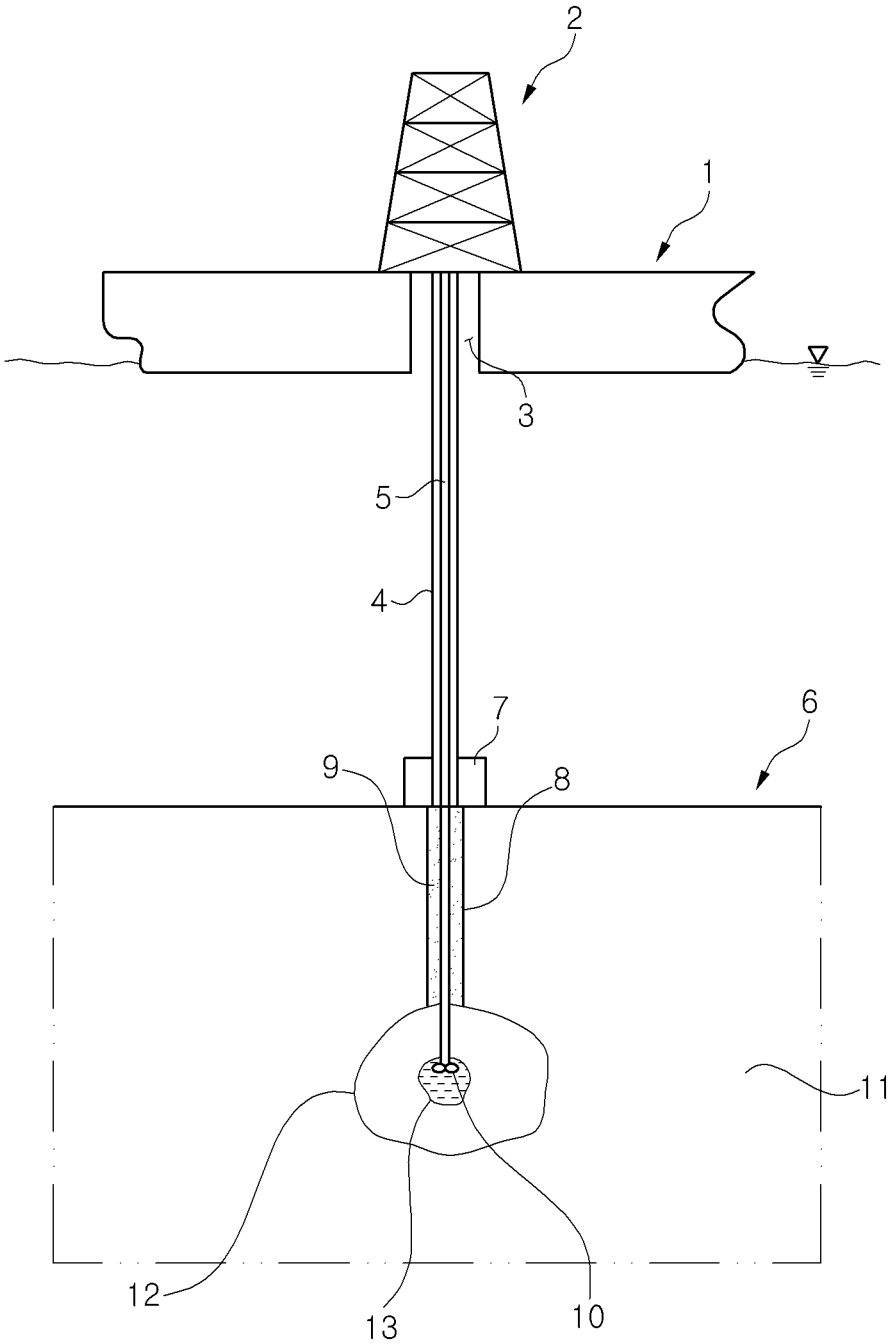
FIG. 1 is a side view illustrating a conventional drill ship which performs a drilling operation on the sea.

Exemplary embodiments of the present invention will be described below in detail with reference to the accompanying drawings.

FIG. 2 illustrates a situation in which a ventilating apparatus for a drill ship sailing around an arctic region is operating in the hot season.

A derrick 110 and a moonpool 120 are ventilated through a ventilating apparatus according to the present invention. The derrick 110 is fixedly installed on a deck (not shown) of a drill ship 100 and the moonpool 120 is formed under the derrick 110, such that drills for a drilling operation or the like move downwardly through the derrick 100 and the moonpool 120. Since this is well known in the shipbuilding industry, detailed description thereof will be omitted for conciseness.

Since the drill ship 100 to which the present invention is applied sails around the arctic region, the derrick 110 has an enclosed structure blocked from the exterior so as to prevent air having a temperature below zero from being directly contacted with a variety of drilling equipment inside the derrick 110.

Although the terms "hot season" and "cold season" are used in this specification, they represent the conditions of the arctic region and thus it should be noted that a temperature does not exceed 10° C. even in a hot season.

Even when the drill ship 100 sails around the arctic region, the ventilating apparatus according to the embodiment of the present invention can prevent the internal temperature of the drill ship 100 from dropping rapidly and can constantly maintain temperature and pressure suitable for sailing and drilling.

To this end, an air supply device 130 installed outside the derrick 110 supplies fresh outside air through a supply fan 131. However, in the case where the ventilating apparatus according to the present invention operates in a hot season, air is not separately heated through a heater 134 of the air supply device 130, considering the temperature of the outside air. The outside air supplied through the air supply device 130 may flow through a duct 136 to a space where the moonpool 120 is formed.

The end of the duct 136 may be coupled to the derrick 110. However, in terms of circulation of outside air, it is more advantageous to couple the end of the duct 136 to the moonpool 120 disposed under the derrick 110, because air can be ventilated through the whole derrick 110.

A wire mesh 137 is formed at the end of the duct 136 coupled to the moonpool 120, whereby air can be effectively supplied to the moonpool 120.

The air supply device 130 includes a supply louver 132 which can allow the inflow of outside air and prevent the inflow of large particles or rainwater. In addition, the air supply device 130 includes a shut-off damper 133 which can shut off an air flow in the event of a fire or other emergency.

An air supply port 150 is formed on the side of the derrick 110. The air supply port 150 may be opened in a hot season. Accordingly, outside air may flow into the derrick 110 through the air supply port 150 as well as the air supply device 130.

In the case where the drill ship 100 according to the present invention sails around the arctic region in a hot season, the supply fan 131 and an exhaust fan 141 may be operated at high speed to supply and exhaust air at high speed. To be specific, since a temperature in a hot season is relatively high as compared to a cold season, it is less likely that the derrick 110 and the moonpool 120 will be frozen. Therefore, the outside air need not stay in a space formed by the derrick 110 and the moonpool 120 for a long time. In a hot season, outside air also flow into the derrick 110 through the air supply port 150, as described above. Therefore, an amount of air for ventilation is sufficient.

The outside air supplied to the moonpool 120 flows upwardly, passes through the derrick 110, and is exhausted out of the derrick 110 through the exhaust fan 141 installed in an air exhaust device 140, as indicated by the arrows in FIG. 2. In such a manner, fresh air is continuously supplied to the moonpool 120 and the derrick 110. Accordingly, even though gas or the like is generated during a drilling operation, it is exhausted immediately to the exterior, thereby ensuring the safety of operations in spite of the use of the derrick 110 having the enclosed structure.

As illustrated in FIG. 2, an exhaust louver 142 may be provided in the air exhaust device 140. The exhaust louver 142 can allow the exhaust of air and prevent the inflow of large particles or rainwater from the exterior.

Since the derrick 110 has the enclosed structure, the internal pressure of a compartment formed by the moonpool 120 and the derrick 110 may rise or drop excessively if waves hit the opened space under the moonpool 120 which is in contact with seawater. To prevent such a rapid pressure variation and maintain the internal pressures of the derrick 110 and the moonpool 120 at constant levels, a pressure regulating damper 111 may be installed on the side of the derrick 110 as illustrated in FIG. 2. The pressure regulating damper 111 suctions or exhausts air according to a variation in the internal pressures of the derrick 110 and the moonpool 120.

FIG. 3 illustrates a situation in which a ventilating apparatus for a drill ship sailing around an arctic region is operating in a cold season.

Since the operation of the ventilating apparatus of the present invention in the cold season is almost identical to the operation in the hot season, the following description will be focused on differences therebetween.

In the cold season of the arctic region, air temperature outside the drill ship 100 is below zero and it is extremely cold. Therefore, cold outside air flowing into the air supply device 130 is heated to an appropriate temperature by the heater 134 and is supplied to the moonpool 120 and the derrick 110.

In addition, considering below zero temperatures outside the drill ship 100, air heated by the heater 134 needs to stay in the space formed by the derrick 110 and the moonpool 120 for a long time. Therefore, the supply fan 131 and the exhaust fan 141 may be operated more slowly than in the hot season.

It is preferable to close the air supply port 150 formed on the side of the derrick 110. Since outside air temperature is extremely low, a variety of drilling equipment may be frozen if air is supplied to the derrick 110 without being heated by the heater 134 or the like.

A plurality of heat blowers 160 may be installed inside the derrick 110 to heat air and forcibly circulate the heated air. Although the air heated by the heater 134 is supplied to the moonpool 120 and the derrick 110, a more effective air ventilation may be achieved by installing an additional heat source, separately from the heater 134, in the inside of the derrick 110, considering the cold season.

According to the ventilating apparatus for the drill ship of embodiments of the present invention, ventilation of warm air into the drill ship makes it possible to meet a temperature maintenance condition required when the drill ship sails around the arctic region. In addition, it is possible to minimize the rapid pressure change due to the influence of waves generated in the moonpool.

In addition, energy can be efficiently used by partially changing the method for operating the ventilating apparatus of the drill ship, depending on the cold season and the hot season of the arctic region.

According to the embodiments of the present invention, the ventilating apparatus for the drill ship can maintain temperatures and pressures of the moonpool and the derrick at appropriate levels, considering the influence of temperature and waves, such that the drill ship is efficiently operating in an arctic region.

Since the derrick and the moonpool have the enclosed spaces blocked from the exterior in order for preventing freezing, it is possible to minimize the influence of the temperature and pressure of the space formed by the derrick and the moonpool according to the external temperature and waves.

Moreover, since the pressure regulating damper prevents the excessive pressure change in the derrick and the moonpool, it is possible to prevent the generation of excessive positive pressure and negative pressure even though waves hit in the moonpool.

While the ventilating apparatus for the drill ship according to the present invention has been described with reference to specific embodiments, it will be apparent to those skilled in the art that various changes and modifications may be made without departing from the spirit and scope of the invention as defined in the following claims. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An arctic drill ship, comprising:

a propulsion system to sail the artic drill ship about the sea;

a ship deck;

a derrick installed on the ship deck;

a moonpool formed under the derrick which is in contact with seawater and exposed to sea waves, and wherein the derrick and the moonpool collectively form a compartment within the artic drill ship that extends from the derrick to a surface of the sea and defines an enclosed space blocked from an exterior environment, the enclosed space of the compartment being susceptible to air pressure fluctuations arising from interaction of the sea waves with the moonpool throughout drilling operations; and a ventilation apparatus, the ventilation apparatus including:

an air supply device arranged to supply outside air to the enclosed space of the compartment collectively formed by the derrick and the moonpool, the air supply device coupled to a moonpool area defined by the moonpool at a lower end of the enclosed space;

an air exhaust device arranged to exhaust the supplied outside air out of the enclosed space through a top end of the derrick opposite the moonpool area; and a pressure regulating damper provided in a side of the derrick between the top end and the moonpool area which supplies air to or exhausts air from the enclosed space to prevent rapid pressure variation such that the internal air pressure within the compartment collectively formed by the derrick and the moonpool is constantly maintained despite the interaction of the sea waves with the moonpool throughout drilling operations.

2. The artic drill ship according to claim 1, wherein the air supply device comprises a heater to heat the outside air.

3. The artic drill ship according to claim 1, wherein the air supply device comprises a shut-off damper to shut off an air flow when an emergency situation occurs while the artic drill ship is sailing.

4. The artic drill ship according to claim 1, wherein the air supply device comprises a supply louver to prevent an inflow of particles other than air.

5. The artic drill ship according to claim 1, wherein the derrick comprises an openable or closable air supply port through which the outside air is supplied.

6. The artic drill ship according to claim 1, further comprising a heat blower provided inside the derrick to heat air for effective ventilation.

7. The artic drill ship according to claim 1, wherein the air exhaust device comprises an exhaust louver.

8. The artic drill ship according to claim 1, wherein, a supply fan is installed in the air supply device, an exhaust fan is installed in the air exhaust device, and the operating speeds of the supply fan and the exhaust fan are changed depending on temperature of the outside air.

9. The artic drill ship according to claim 1, wherein the air supply device supplies the outside air to at least one of the moonpool and the derrick through a duct, and wherein a wire mesh is provided at an end of the duct which is coupled to the at least one of the moonpool and the derrick.

10. An arctic drill ship, comprising:

a ship deck;

a derrick installed on the ship deck;

a moonpool formed under the derrick which is in contact with seawater and exposed to sea waves, and wherein the derrick and the moonpool collectively form a compartment within the artic drill ship that extends from the derrick to a surface of the sea and defines an enclosed space blocked from an exterior environment, the enclosed space of the compartment being susceptible to air pressure fluctuations arising from interaction of the sea waves with the moonpool throughout drilling operations; and a ventilation apparatus, the ventilation apparatus including:

an air supply device arranged to supply outside air to the enclosed space of the compartment collectively formed by the derrick and the moonpool, the air supply device coupled to a moonpool area defined by the moonpool at a lower end of the enclosed space;

an air exhaust device arranged to exhaust the supplied outside air out of the enclosed space through a top end of the derrick opposite the moonpool area; and a pressure regulating damper provided in a side of the derrick between the top end and the moonpool area which supplies air to or exhausts air from the enclosed space to prevent rapid pressure variation such that the internal air pressure within the compartment collectively formed by the derrick and the moonpool is constantly maintained despite the interaction of the sea waves with the moonpool throughout drilling operations.

* * * * *